United States Patent [19]

Perlsweig

[11] Patent Number: 4,799,132

[45] Date of Patent: Jan. 17, 1989

[54] MEANS FOR MOUNTING A MINI-FLASHLIGHT ON A WRITING INSTRUMENT

[76] Inventor: Leon Perlsweig, 23017 Gainford St., Woodland Hills, Calif. 91364

[21] Appl. No.: 196,736

[22] Filed: May 20, 1988

[51] Int. Cl.[4] ..... B43K 29/10

[52] U.S. Cl. ..... 362/118; 362/191; 362/427; 401/195

[58] Field of Search ..... 362/109, 118, 190, 191, 362/418, 427; 401/521, 195

[56] References Cited

U.S. PATENT DOCUMENTS 1,345,962 7/1920 Sanders ..... 362/118

4,047,017 9/1977 Herring ..... 362/118

*Primary Examiner*—Stephen F. Husar

*Attorney, Agent, or Firm*—Brumbaugh, Graves, Donohue & Raymond

[57] ABSTRACT

A clip arrangement for mounting a miniature flashlight on a writing instrument has a pair of spring clips pivotally coupled to the respective ends of an elongated support member and rotatable in a common plane with said member. The clips are shaped and dimensioned to releasably frictionally engage a writing instrument and flashlight, respectively, and are formed to extend from their pivotal couplings in a direction substantially perpendicular to the longitudinal dimensions of the writing instrument and flashlight. The configuration provides improved adjustability of the light relative to the writing instrument and allows ready attachment to and removal from a substantial range of diameters of writing instruments and flashlights.

5 Claims, 1 Drawing Sheet

MEANS FOR MOUNTING A MINI-FLASHLIGHT ON A WRITING INSTRUMENT

BACKGROUND OF THE INVENTION

This invention relates to flashlight mounting devices and more particularly to a mounting means for supporting and positioning a mini-flashlight on a pen or pencil, such that the writing surface is effectively illuminated for the writer, without interfering with the writer's grip on the pen or pencil.

It is frequently necessary to take notes or otherwise record information under conditions of low ambient light or virtual darkness. For example, in a darkened theater or lecture hall, an observer wishing to record impressions or take notes would be unable to do so in the absence of some convenient means to illuminate the writing surface. At the same time, any illuminating means should serve the writer's purpose without casting distracting light over adjacent areas. So-called mini-flashlights, operated on one or two AA bateries, which produce a relatively narrow beam of light suitable for this purpose are available, and various arrangements for combining such a light source with a writing instrument have been proposed. For example, U.S. Pat. No. 4,047,017 to Herring discloses a flashlight bracket clipped to a writing instrument in which the flashlight is riveted to an arm pivotally connected to the bracket. The bracket arrangement is such that in certain positions, the flashlight either interferes with the writer's grasp of the writing instrument or casts a shadow of the writer's hand on the writing surface.

Another form of flashlight-supporting bracket is shown in U.S. Pat. No. 2,189,715 to Hoiseth. In that arrangement, the bracket is separable from both the flashlight and the writing instrument but its angular relationship to each is fixed, providing limited adjustability only by changing its position along the length of the flashlight or the writing instrument or both. Other, nonadjustable forms of flashlight mounting brackets are shown in patents to Hawthorne U.S. Pat. Nos. 1,222,948 and Brooks 1,615,740.

SUMMARY OF THE INVENTION

The present invention avoids the disadvantages of known prior art devices by providing a support arrangement having improved adjustability of the light with respect to the writing instrument, without permanent fastening to either the flashlight or the writing instrument. By employing spring clips to secure pivot arms to the barrel of a mini-flashlight and writing instrument, respectively, the device can be readily removed from both, enabling each to be used separately when so needed. At the same time, the support assembly may be conveniently carried in a briefcase or pocket for use when needed. The clips are designed such that they can accommodate a range of diameters and cross-sectional shapes of both writing instrument and mini-flashlight, thus increasing the utility and versatility of the device. It can be manufactured and sold without limiting its use to particular flashlights or writing instruments. The simplicity of construction of the device of the invention makes it inexpensive to manufacture, adding to its commercial attractiveness.

BRIEF DESCRIPTION OF THE DRAWINGS

The foregoing and other advantages of the invention will become more apparent from the following detailed description of a preferred embodiment, taken in conjunction with the accompanying drawings in which.

DETAILED DESCRIPTION OF THE INVENTION

Figure 1:
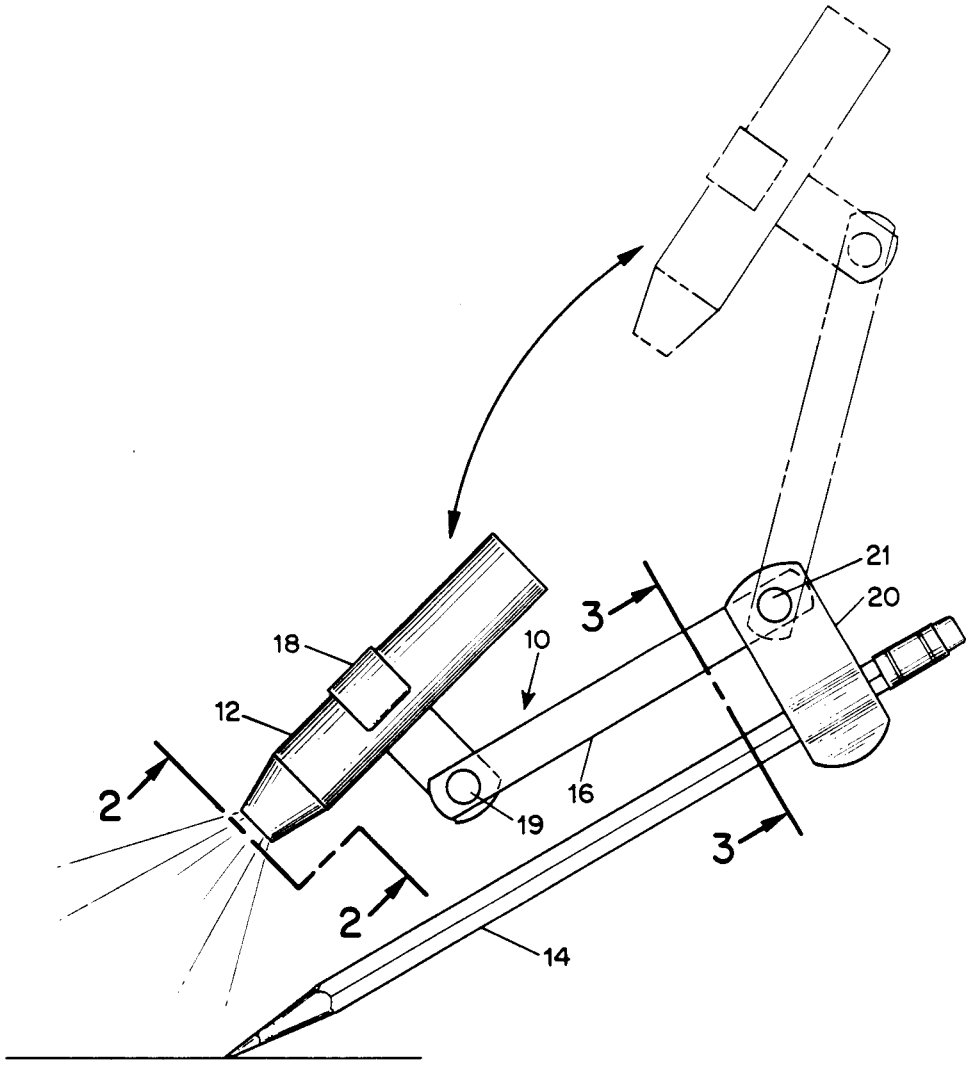
FIG. 1 illustrates the invention in use, supporting a mini-flashlight on a writing instrument, the dotted representation illustrating the range of adjustability of the device.

In FIG. 1, the support arrangement of the invention, indicated generally by the numeral 10, is illustrated in use, mounting a mini-flashlight 12 on a writing instrument, e.g. a pencil, 14. The mini-flashlight 12 may be of any conventional form, comprising a generally cylindrical body housing a battery or batteries, generally of the AA size, and a bulb at its forward end. Similarly, the writing instrument 14 may be of any convenient type, such as a pencil (as illustrated), pen or any kind of marking instrument having an elongated, generally cylindrical body.

The mounting device of the invention includes an elongated support member 16, at the ends of which are pivotally coupled spring clip means 18 and 20, respectively. Each clip means is connected to an end of support member 16 by a friction pivot 19, 21, for example, a rivet fastener that allows the clip means to pivot with respect to the support member upon application of appropriate force but is sufficiently tight to retain the angular relationship between the clip and the member once set.

Figure 2:
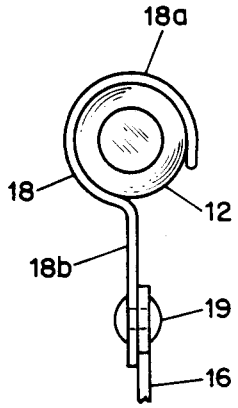
FIG. 2 is a view taken along the line 2—2 of FIG. 1 illustrating one form of spring clip forming part of the invention.
Figure 3:
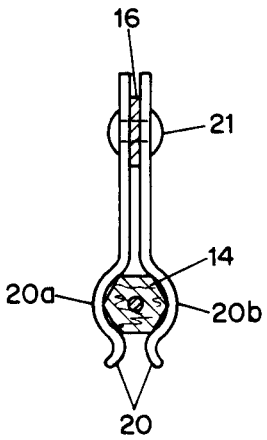
FIG. 3 is a view taken along the lines 3—3 of FIG. 1 illustrating another form of spring clip usable in the invention.

The clip means 18 and 20, shown in greater detail in FIGS. 2 and 3 respectively, pivot about the respective ends of the support member 16 in a common plane and are aligned to support the mini-flashlight and writing instrument relative to each other with their axes in that same plane.

Each of the spring clips 18 and 20 extend from their pivot connection to the support member 16 in a direction substantially perpendicular to the axes of the mini-flashlight and writing instrument, respectively. This arrangement allows for substantial freedom of positioning of the light with respect to the writing instrument to provide a wide degree of adjustability. For example, as shown in continuous line in FIG. 1, with the clip 20 engaging the pencil 14 at its rearward end, thereby giving the writer sufficient length to grasp the pencil in the normal writing position, the light 12 may be positioned such that it is close to the writing point to confine illumination to the area immediately surrounding the point. If wider illumination of the writing surface is desired, the support member 16 and flashlight 12 may be pivoted into the position shown in dotted line in FIG. 1, moving the flashlight rearwardly of and above the writer's hand. Because of the flexibility of the clip means and pivot arrangement, a virtually unlimited number of positions are available to the user, allowing him to find the best possible position to suit his writing grip and illumination needs.

The configuration of the clips 18 and 20 are best shown in FIGS. 2 and 3, respectively. As seen in FIG. 2, the clip 18, formed of a single strip of flat spring material, comprises a curved spring portion 18*a* formed at the end of a straight section 18*b*, the lower end of which is joined to the support member 16 by friction pivot, such as the rivet described above. The curvature of 18*a* is approximately circular and extends over about a 300° arc. The length of the arc will depend on a number of factors, including the springiness of the material used for the clip, the size of the article to be grasped by the spring, etc. In the embodiment shown, the flashlight is engaged by the clip by pushing the flashlight body into the opening in the circular spring portion 18*a*, spreading its free end until the flashlight is fully within the circular portion and firmly grasped by it. The elasticity of the spring member 18*a* is such as to enable it to firmly grasp cylindrical members having a range of cross-sectional size. Thus, within a range, the diameter of the flashlight to be used is not critical to the design of the mounting means.

Similarly, the spring clip arrangement shown in FIG. 3 is capable of gripping writing instruments 14 having a range of diameters. The clip comprises two similarly shaped, opposed members 20 formed of flat spring material, each of which includes a curved section 20*a*, 20*b* from which extends a straight portion pivoted to the end of the support member 16 by friction pivot element 21, which, like pivot 19, can be a rivet. The member 16 is retained by the friction pivot 21 between the ends of the extensions of the spring members. Alternatively, clip 20 can be a single strip of spring material, folded in half to provide the two opposed members 20.

To grasp the writing instrument, the lower free ends of the spring members 20 are spread to the extent necessary by pushing the writing instrument 14 between the divergent ends of the members 20 until it reaches the area defined by the curved portions of the spring members. The elastic memory of members 20 urge them together to the extent permitted by the writing instrument, thereby grasping it firmly. The configuration of the clip 20 is such that it can firmly grip over a substantial range of different diameters and cross sectional shapes. This versatility may be facilitated by varying the shape and size of the curved sections 20*a* and 20*b*; e.g. section 20*a* may be sized to grasp a ¼" diameter instrument while section 20*b* is sized to grasp a diameter of 7/16", thus allowing the spring clip to accommodate both sizes.

Any suitable material having the requisite strength, resiliency and elastic memory can be used to fabricate the mounting means of the invention. Spring steel may be used for the clip members and the support member or a suitable plastic, having the requisite properties may be used. Similarly, any suitable type of friction pivot may be employed for the joints 19 and 21 in lieu of the ivets shown. In any case, the device is capable of being fabricated simply and inexpensively and may be quickly attached to or disengaged from the writing instrument and the flashlight as needed. Since no special adaptation to either the flashlight or the writing instrument is required, the device may be sold separately from those elements, allowing the purchaser to use it with whatever variety of such devices he may have at hand or may acquire in the future.

Although in the illustrated embodiment, different forms of spring clips are shown for the mini-flashlight and writing instrument, it will be understood that either form of clip shown can be used for either or both of the mini-flashlight and writing instrument. The foregoing and other modifications will occur to those skilled in the art without departing from the spirit of the invention as defined in the appended claims.

I claim:

1. Mounting means for adjustably and removably supporting an illuminating device on a writing instrument comprising an elongated support member, first clip means pivotally coupled to one end of said member, said first clip means being rotatable about said one end in the plane of said member and adapted to releasably frictionally engage an elongated writing instrument, and second clip means pivotally coupled to the other end of said member, said second clip means being rotatable about said other end in a common plane with said member and said first clip means and adapted to releasably frictionally engage an elongated illuminating device, said first and second clip means extending from their pivotal couplings to said member in a direction substantially perpendicular to the longitudinal dimensions of writing instrument and illuminating device, respectively, when said clip means are in engagement with said writing instrument and illuminating device.

2. The mounting means of claim 1 in which said first and second clip means are coupled to said member by frictional pivots whereby a predetermined force is required to vary the angular relationships between each clip means and said member.

3. The mounting means of claim 2 wherein each of said clip means comprises at least one curved spring member capable of deformation to grasp generally cylindrical elements of varying transverse dimension, and an extension of said spring member coupled to a respective end of said support member.

4. The mounting means of claim 2 wherein one of said clip means comprises a single length of spring material, one end of which is formed into a generally circular clip member, said clip member adapted to be outwardly expended upon insertion of a cylindrical article to firmly grasp said article, the other end of said length of spring material being pivotally coupled to said support member.

5. The mounting means of claim 2 wherein one of said clip means comprises a pair of opposed lengths of spring material, each of which includes a curved portion adjacent one end, the curved portions of said lengths of spring material facing each other to define an open space, said lengths of spring material adapted to be spread apart by insertion of a cylindrical article between the free ends of said curved portions and into said space to firmly grasp said article, the other ends of said opposed length of spring material being pivotally coupled to said support member.

* * * * *